US005498267A

United States Patent [19]

Russ et al.

[11] Patent Number: 5,498,267

[45] Date of Patent: Mar. 12, 1996

[54] PROCESS AND USE OF REACTIVE DISPERSE DYES FOR DYEING AND PRINTING AMINATED, TEXTILE COTTON AND COTTON-POLYESTER BLEND FABRICS

[75] Inventors: Werner H. Russ, Flörsheim; Andreas Schrell; Andreas von der Eltz, both of Frankfurt am Main, all of Germany

[73] Assignee: Hoechst AG, Germany

[21] Appl. No.: 288,839

[22] Filed: Aug. 11, 1994

[30] Foreign Application Priority Data

Aug. 13, 1993 [DE] Germany ..... 43 27 301.7

[51] Int. Cl.[6] ..... D06P 1/38; D06P 1/16; D06P 3/66; D06P 3/854

[52] U.S. Cl. ..... 8/532; 8/542; 8/543; 8/565; 8/567; 8/570; 8/572; 8/574; 8/576; 8/578; 8/604; 8/606; 8/918; 8/921

[58] Field of Search ..... 8/493, 532, 539, 8/540, 541, 542, 543, 181, 188, 189, 194, 196, 918, 921, 567, 597, 599, 565, 568–579, 606, 604

[56] References Cited

U.S. PATENT DOCUMENTS

| | | | |
|---|---|---|---|
| 4,276,047 | 6/1981 | Imahori et al. | 8/532 |
| 4,277,246 | 7/1981 | Lehinant et al. | 8/532 |
| 4,284,410 | 8/1981 | Nischwitz et al. . | |
| 4,319,881 | 3/1982 | Koci et al. | 8/532 |
| 4,331,442 | 5/1982 | Uhlig et al. | 8/564 |
| 4,676,803 | 6/1987 | Harmes et al. | 8/532 |

FOREIGN PATENT DOCUMENTS

| | | |
|---|---|---|
| 2084585 | 6/1993 | Canada . |
| 9199 | 4/1980 | European Pat. Off. . |
| 546476 | 6/1993 | European Pat. Off. . |
| 2226504 | 12/1974 | France . |
| 1463682 | 4/1973 | United Kingdom . |

OTHER PUBLICATIONS

Journal of Applied Polymer Science, vol. 21, 1933–1944 (1977) *Grafting of Cyclic Carbonates onto Cotton and Modified Cottons.*

*Primary Examiner*—Margaret Einsmann
*Attorney, Agent, or Firm*—Connolly & Hutz

[57] ABSTRACT

Process and use of reactive disperse dyes for dyeing and printing aminated, textile cotton and cotton-polyester blend fabrics Hydroxyl-containing materials, in particular fiber materials, such as cellulose fiber materials, which have been modified with an amino-containing compound are dyed as such or in blend with polyester fibers with the aid of a fiber-reactive disperse dye in an aqueous, low-electrolyte or completely electrolyte-free medium and in the absence of an alkaline or alkali-donating agent at a temperature of between 100° and 210° C. Not only the modified cellulose-containing material but also the polyester material can be dyed in one and the same dyeing process with one and the same fiber reactive disperse dye. A uniform overall dyeing not only for modified hydroxyl-containing material but also for polyester material is obtained.

11 Claims, No Drawings

PROCESS AND USE OF REACTIVE DISPERSE DYES FOR DYEING AND PRINTING AMINATED, TEXTILE COTTON AND COTTON-POLYESTER BLEND FABRICS

Process and use of reactive disperse dyes for dyeing and printing aminated, textile cotton and cotton-polyester blend fabrics Currently, the dyeing of cotton with reactive dyes requires alkaline agents for fixation and also electrolyte salts for better exhaustion in order that satisfactory results may be obtained. Polyester, by contrast, is dyed at elevated temperatures with disperse dyes which, however, are chemically unstable under alkaline conditions.

It would therefore be desirable for the future to have a method of dyeing textile fibers, preferably those which contain the basic structure of α,β-glucose and of polyester at one and the same time, in a single bath using only one class of dyes, i.e. without interim rinsing processes or changes to the pH of the dyeing liquors. By reducing the load on the wastewater and the energy consumption due to shortened machine occupation times and by providing scope for varying the dyeing or printing process, such a method would make a significant contribution to the ecologically improved processing of woven and knitted textile fabrics.

In the present invention it has now been found that, surprisingly, reactive disperse dyes will give level and strong dyeings having good service fastness properties without the use of alkaline agents and electrolyte salts on using a cellulosic fiber material which has been modified by means of amino-containing compounds.

Owing to their chemical structure, this class of dyes is capable of reacting not only with cotton but also with polyester materials under neutral reaction conditions and at appropriate temperatures. Yet this leaves the problem of being unable to dye cotton, even with reactive dyes, without addition of alkali. One way out is "amination". Modified, textile fiber materials, by contrast, are dyeable without any added salt or alkali and thus also permit the single-bath dyeing of blend fabrics at elevated temperatures with dyes of the same class.

The present invention accordingly provides a process for dyeing materials composed of hydroxyl-containing fibers, such as cellulose fibers, or blends of hydroxyl-containing fibers with polyester fibers, which comprises using a hydroxyl-containing fiber material that is a fiber material which has been modified with an amino-containing compound and a dye that is a fiber-reactive disperse dye and dyeing in an aqueous, low-electrolyte or completely electrolyte-free medium and in the absence of an alkaline or alkali-donating agent, for example at a pH of between 5 and 7, preferably between 5.5 and 6.5, and at a temperature between 100° and 210° C., preferably between 110° and 190° C.

Dyeing for the purposes of the present invention also comprehends the customary processes for printing textile materials and dyeing using inkier printers.

Modified hydroxyl-containing fiber materials which according to the invention can be used in the process of the invention are for example those which are described in Canadian Patents 1,267,490 and 2,084,585, in Australian Patent Application Publication No. 609 460 and in Japanese Patent Application Publication Hei-5-5279, further those fiber materials which were pretreated and modified with the aftertreating compounds used in German Offenlegungsschrift 2,930,738, and further in particular hydroxyl-containing fiber materials modified according to the directions of Canadian Patent Application Publication No. 2 084 585 or with the compounds of the formula (1) described hereinafter.

Amino-containing compounds for the process of the invention are preferably those of the formula

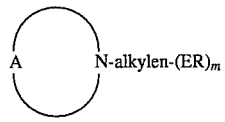

where

ER is an ester group;

A and N together with 1 or 2 alkylene groups of 1 to 4 carbon atoms form the bivalent radical of a heterocyclic ring, wherein A is an oxygen atom or a group of the formula (a), (b) or (c)

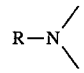

(a)

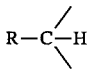

(b)

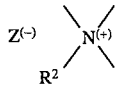

(c)

where

R is a hydrogen atom or an amino group or an alkyl group of 1 to 6 carbon atoms which may be substituted by 1 or 2 substituents selected from the group consisting of amino, sulfo, hydroxyl, sulfato, phosphato and carboxyl, or an alkyl group of 3 to 8 carbon atoms which is interrupted by 1 or 2 hetero groups selected from —O— and —NH— and may be substituted by an amino, sulfo, hydroxyl, sulfato or carboxyl group, $R^1$ is hydrogen, methyl or ethyl, $R^2$ is hydrogen, methyl or ethyl, and $Z^{(-)}$ is an anion;

alkylen is a straight-chain or branched alkylene radical of 2 to 6 carbon atoms which may be substituted by 1 or 2 hydroxyl groups or is a straight-chain or branched alkylene radical of 3 to 8 carbon atoms which is interrupted by 1 or 2 hetero groups selected from —O— and —NH—;

m is 1 or 2 or 2;

the amino, hydroxyl and ester groups can be attached to a primary, secondary or tertiary carbon atom of the alkylene radical;

and further those of the formula

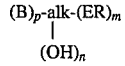

where

ER is an ester group;

B is the amino group of the formula $H_2N$— or an amino or ammonium group of the formula (d) or (e)

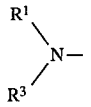

(d)

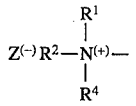

(e)

where $R^1$, $R^2$ and $Z^{(-)}$ are each as defined above, $R^3$ is methyl or ethyl, and $R^4$ is hydrogen, methyl or ethyl;

p is 1 or 2;

alk is a straight-chain or branched alkylene radical of 2 to 6 carbon atoms or is a straight-chain or branched alkylene radical of 3 to 8 carbon atoms which is interrupted by 1 or 2 hetero groups selected from —O— and —NH— and is preferably a straight-chain or branched alkylene radical of 2 to 6 carbon atoms;

m is 1 or 2;

n is from 1 to 4;

the amino, hydroxyl and ester groups can be attached to a primary, secondary or tertiary carbon atom of the alkylene radical.

Preference for the purposes of the present invention is given to those of the aforementioned amino-containing compounds in which the ester group ER is a sulfato group of the formula $—OSO_3M$ where M is hydrogen or an alkali metal, for example sodium, potassium or lithium, with particular preference being given to the amino-containing compound N-(β-sulfatoethyl)piperazine.

Also of importance are compounds of the formula (1)

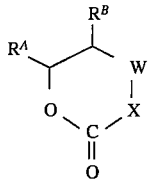

(1)

where $R^A$ is hydrogen or alkyl of 1 to 3 carbon atoms which may be substituted by hydroxyl or a group of the formula (2) or (3)

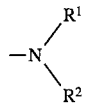

(2)

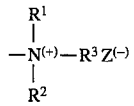

(3)

where $R^1$ is hydrogen, methyl or ethyl, $R^2$ is hydrogen, methyl or ethyl, and $R^3$ is hydrogen, methyl or ethyl, or $R^1$ and $R^2$ together with the nitrogen atom are a saturated heterocyclic radical formed from an alkylene radical of 5 to 8 carbon atoms or two alkylene radicals of 1 to 4 carbon atoms and an oxygen atom or an amino group of the formula —NH—, for example N-piperazino, N-piperidino or N-morpholino, and $Z^{(-)}$ is an anion, for example chloride, hydrogensulfate or sulfate;

$R^B$ has one of the meanings specified for $R^A$;

W is a direct bond or a group of the formula $—CHR^C—$ where $R^C$ has one of the meanings specified for $R^A$;

X is —O— or —NH—, but preferably only one of the radicals $R^A$, $R^B$ and $R^C$ is an alkyl group having a group of the formula (2) or (3). Such hetero-cycloaliphatic compounds are for example 2-oxo-1,3-oxazolidine, 4-aminomethyl-2-oxo-1,3-oxazolidine, 5-aminomethyl-2-oxo-1,3-oxazolidine, 4-(trimethylammoniummethyl)- 2-oxo-1,3-oxazolidine chloride, 5-(trimethylammoniummethyl)-2-oxo-1,3-oxazolidine chloride or 1-(trimethylammoniummethyl)ethylene carbonate chloride.

The compounds of the formula (1) can be prepared by known methods as numerously described in the literature (see Houben-Weyl, Methoden der Organischen Chemie, 4th edition, volume E4, pages 82–88 and 192 ff.), for example by reacting an alkanediol which has a latent nitrogen-containing functional group in the side chain with phosgene in aqueous solution at a pH between 7 and 9 to form the hetero-cycloaliphatic carbonates or for example by reacting aminoalkanols with phosgene in aqueous solution to form the hetero-cycloaliphatic carbamic acid compounds (2-oxo-1,3-oxazolidines).

The modification of the hydroxyl-containing fiber materials with the compounds of the formula (1) can be effected analogously to the directions of European Patent Application Publication No. 0 546 476, for example by having the compound of the formula (1) act on the original hydroxyl-containing fiber material in aqueous, alkaline solution at a temperature between 60° and 200° C., preferably between 90° and 190° C. This can be done for example by bringing the original hydroxyl-containing fiber material into contact with the compound of the formula (1) in alkaline aqueous solution in a known and customary manner, for example by padding or dipping into this solution, and by subjecting the fiber material thus associated with the alkaline solution of the compound of the formula (1) to a heat treatment between 100° and 230° C., preferably between 120° and 190° C., for example by means of hot air of the fabric impregnated with the solution or in the dyeing liquor itself in a closed apparatus. Generally the compound of the formula (1) is present in the alkaline aqueous solution in a concentration between 0.1 and 20% by weight, preferably between 5 and 10% by weight. The alkaline agent used can be for example sodium hydroxide, sodium carbonate or potassium carbonate, which generally is present in a concentration between 0.1 and 20% by weight, preferably between 5 and 10% by weight, and confers a pH between 10 and 14 on the solution.

The fiber material to be dyed according to the invention in the process of the invention can be present in any processing state, for example as yarn, staple, slubbing and piece goods, such as woven fabric and knitted fabric.

Dyeing methods which can be used according to the invention include for example the various exhaust methods, such as dyeing on the Jigger or on the reel beck or dyeing from long or short liquor, the dyeing in jet dyeing machines or by a pad-superheated steam fixation process for pure modified hydroxyl-containing fiber materials and the high temperature exhaust process and thermosoling process for polyester fibers or blends of polyester fibers with modified hydroxyl-containing fibers. To dye the modified hydroxyl-containing fiber materials, such as the modified cotton fiber, it is sufficient to employ a dyeing temperature within the range from 100° to 140° C., preferably 110° to 130° C. In the case of fiber blend materials a dyeing temperature above 120° C., preferably above 130° C., in particular from 170° to 210° C., is sufficient to dye the polyester portion if an exhaust method is used. Fiber blend materials which are usable according to the invention are customarily dyed at above 180° C. on use of the thermosoling process. Dyeing methods usable according to the invention also include the customary printing processes for producing print on textile fiber materials, including ink jet printing and transfer printing. Here too, depending on the type of fiber used, the suitable temperature range for fixing the fiber-reactive disperse dye has to be chosen. For instance, the fiber-reactive disperse dye applied by the ink jet technique to a blend fabric of modified cellulose fiber and polyester fiber usable according to the invention can be fixed on the fiber material by means of a thermosoling method following a brief predrying phase.

The dyeings obtainable according to the invention on the modified hydroxyl-containing fiber materials require no further aftertreatment following removal from the dyebath or the completion of the fixation of the dye on the substrate, in particular no costly aftertreatment process involving a wash. It is generally sufficient for the dyed substrate to be subjected to a customary single or multiple rinse with warm or hot and, if necessary, cold water which may contain a nonionic wetting agent. There is no need for a final boil of the dyed substrate with a detergent solution to improve the wet fastness properties.

Fiber-reactive disperse dyes which according to the invention can be used in the dyeing process of the invention are dyes which, in addition to the fiber-reactive group, contain no water-solubilizing group and in which the fiber-reactive group itself is or contains no water-solubilizing group or else contains only such a water-solubilizing group which is split off under the dyeing conditions, for example β-sulfatoethylsulfonyl which is capable of changing into vinylsulfonyl at temperatures above 100° C.

Fiber-reactive groups are in general those molecular moieties which are capable of reacting with hydroxyl groups of the fiber materials, for example of cellulose, or with the amino and thiol groups of fiber materials, for example of wool and silk or of synthetic polymers, such as polyamides, or with the amino groups of the amino-modified hydroxyl-containing fiber materials and of entering a covalent chemical bond with these groups. Such fiber-reactive groups, large numbers of which have been described in the literature, include for example: vinylsulfonyl, β-chloroethylsulfonyl, β-sulfatoethylsulfonyl, β-acetoxyethylsulfonyl, β-thiosulfatoethylsulfonyl, N-methyl-N-(β-sulfatoethylsulfonyl)amino, acryloyl, —CO—CCl=$CH_2$, —CO—CH=CH—Cl, —CO—CCl=CHCl, —CO—CCl=CH—$CH_3$, —CO—CBr=$CH_2$, —CO—CH=CH—Br, —CO—CBr=CH—$CH_3$, —CO—CCl=CH—COOH, —CO—CH=CCl—COOH, —CO—CBr=CH—COOH, —CO—CH=CBr—COOH, —CO—CCl=CCl—COOH, —CO—CBr=CBr—COOH, β-chloro- or β-bromo-propionyl, 3-phenylsulfonylpropionyl, 3-methylsulfonylpropionyl, 3-chloro-3-phenylsulfonylpropionyl, 2,3-dichloropropionyl, 2,3-dibromopropionyl, 2-fluoro-2-chloro-3,3-difluorocyclobutane-2-carbonyl, 2,2,3,3-tetrafluorocyclobutane-1-carbonyl or -1-sulfonyl, β-(2,2,3,3-tetrafluorocyclobut-1-yl)acryloyl, α- or β-methylsulfonylacryloyl, propionyl, chloroacetyl, bromoacetyl, 4-(β-chloroethylsulfonyl)butyryl, 4-vinylsulfonylbutyryl, 5-(β-chloroethylsulfonyl)valeryl, 5-vinylsulfonylvaleryl, 6-(β-chloroethylsulfonyl)caproyl, 6-vinylsulfonylcaproyl, 4-fluoro-3-nitrobenzoyl, 4-fluoro-3-nitrophenylsulfonyl, 4-fluoro-3-methylsulfonylbenzoyl, 4-fluoro-3-cyanobenzoyl, 2-fluoro-5-methylsulfonylbenzoyl, 2,4-dichlorotriazin-6-yl, 2,4-dichloropyrimidin-6-yl, 2,4,5-trichloropyrimidin-6-yl, 2,4-dichloro-5-nitro- or -5-methyl- or -5-carboxymethyl- or -5-carboxy- or -5-cyano- or -5-vinyl- or -5-sulfo- or -5-mono-, -di- or -trichloromethyl- or -5-methylsulfonylpyrimidin-6-yl, 2,5-dichloro-4-methylsulfonylpyrimidin-6-yl, 2-fluoro-4-pyrimidinyl, 2,6-difluoro-4-pyrimidinyl, 2,6-difluoro-5-chloro-4-pyrimidinyl, 2-fluoro-5,6-dichloro-4-pyrimidinyl, 2,6-difluoro-5-methyl-4-pyrimidinyl, 2,5-difluoro-6-methyl-4-pyrimidinyl, 2-fluoro-5-methyl-6-chloro-4-pyrimidinyl, 2-fluoro-5-nitro-6-chloro-4-pyrimidinyl, 5-bromo-2-fluoro-4-pyrimidinyl, 2-fluoro-5-cyano-4-pyrimidinyl, 2-fluoro-5-methyl-4-pyrimidinyl, 2,5,6-trifluoro-4-pyrimidinyl, 5-chloro-6-chloromethyl-2-fluoro- 4-pyrimidinyl, 2,6-difluoro-5-bromo-4-pyrimidinyl, 2-fluoro-5-bromo-6-chloromethyl-4-pyrimidinyl, 2,6-difluoro- 5-chloromethyl-4-pyrimidinyl, 2,6-difluoro- 5-nitro-4-pyrimidinyl, 2-fluoro-6-methyl-4-pyrimidinyl, 2-fluoro-5-chloro-6-methyl-4-pyrimidinyl, 2-fluoro- 5-chloro-4-pyrimidinyl, 2-fluoro-6-chloro-4-pyrimidinyl, 6-trifluoromethyl-5-chloro-2-fluoro-4-pyrimidinyl, 6-trifluoromethyl-2-fluoro-4-pyrimidinyl, 2-fluoro- 5-nitro-4-pyrimidinyl, 2-fluoro-5-trifluoromethyl- 4-pyrimidinyl, 2-fluoro-5-phenyl- or -5-methylsulfonyl- 4-pyrimidinyl, 2-fluoro-5-carboxamido-4-pyrimidinyl, 2-fluoro-5-carbomethoxy-4-pyrimidinyl, 2-fluoro-5-bromo- 6-trifluoromethyl-4-pyrimidinyl, 2-fluoro-6-carboxamido- 4-pyrimidinyl, 2-fluoro-6-carbomethoxy-4-pyrimidinyl, 2-fluoro-6-phenyl-4-pyrimidinyl, 2-fluoro-6-cyano- 4-pyrimidinyl, 2,6-difluoro-5-methylsulfonyl-4-pyrimidinyl, 2-fluoro-5-sulfonamido-4-pyrimidinyl, 2-fluoro- 5-chloro-6-carbomethoxy-4-pyrimidinyl, 2,6-difluoro-5-trifluoromethyl-4-pyrimidinyl, 2,4-bis(methylsulfonyl)pyrimidin- 4-yl, 2,5-bis(methylsulfonyl)-5-chloropyrimidin- 4-yl, 2-methylsulfonylpyrimidin-4-yl, 2-phenylsulfonylpyrimidin- 4-yl, 2-methylsulfonyl-5-chloro-6-methylpyrimidin- 4-yl, 2-methylsulfonyl-5-bromo-6-methylpyrimidin- 4-yl, 2-methylsulfonyl-5-chloro-6-ethylpyrimidin-4-yl, 2-methylsulfonyl-5-chloromethylpyrimidin-4-yl, 2-methylsulfonyl-5-nitro-6-methylpyrimidin-4-yl, 2,5,6-trismethylsulfonylpyrimidin-4-yl, 2-methylsulfonyl-5,6-dimethylpyrimidin-4-yl, 2-ethylsulfonyl-5-chloro-6-methylpyrimidin-4-yl, 2-methylsulfonyl-6-chloropyrimidin- 4-yl, 2,6-bis(methylsulfonyl)-5-chloropyrimidin- 4-yl, 2-methylsulfonyl-6-carbomethoxypyrimidin-4-yl, 2-methylsulfonyl-5-cyano-6-methoxypyrimidin-4-yl, 2-methylsulfonyl-5-chloropyrimidin-4-yl, 2-methylsulfonyl-5-bromopyrimidin-4-yl, 2-phenylsulfonyl-5-chloropyrimidin-4-yl, 2,4-dichloropyrimidine-6-carbonyl or -6-sulfonyl, 2,4-dichloropyrimidine-5-carbonyl or -5-sulfonyl, 2-chloro-4-methylpyrimidine-5-carbonyl, 2-methyl-4-chloropyrimidine-5-carbonyl, 2-methylthio-4-fluoropyrimidine-5-carbonyl, 6-methyl-2,4-dichloropyrimidine- 5-carbonyl, 2,4,6-trichloropyrimidine-5-carbonyl, 2,4-dichloropyrimidine-5-sulfonyl, 2,4-dichloro- 6-methylpyrimidine-5-carbonyl, or -5-sulfonyl, 2-methylsulfonyl-6-chloropyrimidine-4 and -5-carbonyl, 2,6-bis(methylsulfonyl)pyrimidine-4- or -5-carbonyl, 2-ethylsulfonyl-6-chloropyrimidine-5-carbonyl, 2,4-bis(methylsulfonyl)pyrimidine- 5-sulfonyl, 2-methylsulfonyl- 4-chloro-6-methylpyrimidine-5-sulfonyl or -5-carbonyl, 2-chloroquinoxaline-3-carbonyl, 2- or 3-monochloroquinoxaline- 6-carbonyl, 2- or 3-monochloroquinoxaline- 6-sulfonyl, 2,3-dichloroquinoxaline-5- or -6-carbonyl, 2,3-dichloroquinoxaline-5- or -6-sulfonyl, 1,4-dichlorophthalazine- 6-sulfonyl or -6-carbonyl, 2,4-dichloroquinazoline- 7- or -6-sulfonyl or -carbonyl, 2,4,6-trichloroquinazoline- 7- or -8-sulfonyl, 2- or 3- or 4-(4',5'-dichloropyridaz-6'-on-1'-yl)phenylsulfonyl or -carbonyl, β-(4',5'-dichloropyridaz-6'-on-1'-yl)pro-pionyl, 3,6-dichloropyridazine-4-carbonyl or -4-sulfonyl, 2-chlorobenzothiazole-5- or -6-carbonyl or -5- or -6-sulfonyl, 2-arylsulfonyl- or 2-alkylsulfonylbenzothiazole- 5- or -6-carbonyl or -5- or -6-sulfonyl, such as 2-methylsulfonyl or 2-ethylsulfonylbenzothiazole-5- or -6-sulfonyl or -carbonyl, 2-phenylsulfonylbenzothiazole-5- or -6-sulfonyl or -carbonyl.

Particularly interesting fiber-reactive radicals are fluoro- and chloro-1,3,5-triazine radicals of the formula (4)

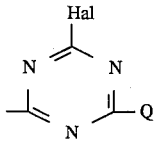

(4)

where Hal is chlorine or fluorine and Q is an amino, alkylamino, N,N-dialkylamino, cycloalkylamino, N,N-dicycloalkylamino, aralkylamino, arylamino, N-alkyl-N-cyclohexylamino or N-alkyl-N-arylamino group, or an amino group which contains a heterocyclic radical which can have a further fused-on carbocyclic ring or amino groups in which the aminonitrogen atom is part of an N-heterocyclic ring which may contain further hetero atoms, and also hydrazino and semicarbazido groups, the alkyl radicals mentioned being straight-chain or branched and low molecular weight or high molecular weight and are preferably those having from 1 to 6 carbon atoms. Suitable cycloalkyl, aralkyl and aryl radicals are in particular cyclohexyl, benzyl, phenethyl, phenyl and naphthyl radicals; heterocyclic radicals are in particular furan, thiophene, pyrazole, pyridine, pyrimidine, quinoline, benzimidazole, benzothiazole and benzoxazole radicals. Suitable amino groups in which the amino nitrogen is part of a N-heterocyclic ring are preferably radicals of six-membered N-heterocyclic compounds which may contain nitrogen, oxygen or sulfur as further hetero atoms. The abovementioned alkyl, cycloalkyl, aralkyl and aryl radicals, the heterocyclic radicals and also the N-heterocyclic rings can be additionally substituted, for example by halogen, such as fluorine, chlorine or bromine, nitro, cyano, trifluoromethyl, sulfamoyl, carbamoyl, $C_1$–$C_4$-alkyl, $C_1$–$C_4$-alkoxy, acylamino groups, such as acetylamino or benzoylamino or ureido. Examples of such amino groups are —$NH_2$, methylamino, ethylamino, propylamino, isopropylamino, butylamino, hexylamino, β-methoxyethylamino, γ-methoxypropylamino, β-ethoxyethylamino, N,N-dimethylamino, N,N-diethylamino, β-chloroethylamino, β-cyanoethylamino, γ-cyanopropylamino, benzylamino, phenethylamino, cyclohexylamino, phenylamino, toluidino, xylidino, chloroanilino, anisidino, phenetidino, N-methyl-N-phenylamino, N-ethyl-N-phenylamino, morpholino, piperidino, piperazino, hydrazino and semicarbazido.

Furthermore, Q can be an amino radical of the formula —$NR^{10}R^{11}$ in which $R^{10}$ is hydrogen or alkyl of 1 to 4 carbon atoms, such as methyl or ethyl, and $R^{11}$ is phenyl which is substituted by a fiber-reactive radical of the vinyl sulfone series directly or via a methylamino, ethylamino, methylene, ethylene or propylene group and which may be additionally substituted by 1 or 2 substituents selected from the group consisting of methoxy, ethoxy, methyl, ethyl and chlorine, or $R^{11}$ is alkyl of 2 to 4 carbon atoms, such as ethyl or n-propyl, which is substituted by a fiber-reactive group of the vinyl sulfone series, or alkylenephenyl having an alkylene radical of 1 to 4 carbon atoms whose phenyl is substituted by a fiber-reactive radical of the vinyl sulfone series, or in which $R^{10}$ and $R^{11}$ are each alkyl of 2 to 4 carbon atoms, such as ethyl or n-propyl, which are substituted by a fiber-reactive group of the vinyl sulfone series, or in which $R^{10}$ and $R^{11}$ are each alkylene of 3 to 8 carbon atoms which is interrupted by 1 or 2 oxy and/or amino groups and to which a vinylsulfonyl, β-chloroethylsulfonyl, β-sulfatoethylsulfonyl, β-thiosulfatoethylsulfonyl or β-acetyloxyethylsulfonyl group is attached as a fiber-reactive group in the terminal position.

Such fiber-reactive disperse dyes are described for example in U.S. Pat. Nos. 3,974,160, 3,959,338, 4,025,646, 4,473,499, 4,500,455, 4,515,716 and 4,837,390, Swiss Patent No. 564,515 and Japanese Patent Application Publication Hei-3-247 665. The statements in U.S. patent documents about these fiber-reactive disperse dyes shall form part of the disclosure content of the present invention.

The Examples which follow illustrate the invention. Parts and percentages are by weight, unless otherwise stated. Parts by weight bear the same relation to parts by volume as the kilogram to the liter.

EXAMPLE 1

1000 parts of cotton tricot are brought together in a jet dyeing apparatus with 15,000 parts of an aqueous pretreatment liquor containing 750 parts of N-(2-sulfatoethyl)piperazine and 450 parts of sodium hydroxide. The liquor is heated to 130° C. with continuous circulation of the goods in the apparatus. The liquor is left at 130° C. for 30 minutes, it is subsequently cooled down to 80° C., and the cotton material is washed initially with cold water, then with 60° C. water with or without a commercial wetting agent, and once more thoroughly with cold water. While the material thus pretreated is still wet, 20,000 parts of water are added to it in the same machine apparatus. To this solution are added, by metering, a total of 30 parts of a dye dispersion which contains the reactive disperse dye known from Example 93 of U.S. Pat. No. 3,843,624 and the temperature is raised to 120° C. and maintained for 60 minutes. Following an after-running time of 5 minutes, the colorless residual liquor is discharged and the material is washed and dried by conventional methods. The result obtained is a strong orange dyeing, in which the two fiber portions have been dyed to the same depth of shade, having very good service fastness properties.

EXAMPLE 2

10 parts of a polyester-cotton blend fabric are pratreared by a conventional exhaust process at 95° C. for 15 min in a liquor ratio of 10:1 with a liquor containing, per 1000 parts of water, 50 parts of N-(2-sulfatoethyl)piperazine and 20 parts of sodium hydroxide. This process is followed by a wash, initially with cold water, then with 60° C. water which may contain a commercial nonionic surfactant. After a further wash with cold water, the material thus pretreated is carried off directly into a single-bath dyeing process. For this, 0.1 part of the fiber-reactive disperse dye known from Example 93 of U.S. Pat. No. 3,843,624 is dispersed in 200 parts of water and brought together with the blend fabric in an HT apparatus in which the dyeing liquor is heated to 130° C. After 30 minutes the liquor, which is now colorless, is cooled down and removed, and the fabric is washed in a conventional manner. The result obtained is a strong level reddish orange dyeing on both fiber portions, which in its fastness properties is equivalent to a prior art dyeing.

EXAMPLE 3

30 parts of bleached cotton yarn are exposed on a cross-wound package in a yarn dyeing apparatus to 450 parts of a pretreatment liquor, consisting of 50 parts of N-(2-sulfatoethyl)piperazine, 30 parts of sodiumhydroxide and 1000 parts of water, by pumping the liquor, which has been heated to 130° C., through the package alternately from in to out and from out to in. After 30 min the liquor is cooled down, and the dyed material is thoroughly rinsed with cold water and then washed at 60° C. for about 5 min with or without a nonionic surfactant. After a renewed rinse, the yarn is directly subjected to a dyeing process. For this purpose, the dyeing apparatus is filled with 450 parts of an aqueous liquor containing in dispersion 0.6 part of the fiber-reactive disperse dye known from Example 102 of U.S. Pat. No. 3,843,624 and the liquor is heated to 120° C. with the liquor circulation corresponding to that employed in the pretreatment process. After 30 min at 120° C. the liquor is cooled down and is removed and the dyed material is rinsed and washed in a conventional manner. The result obtained is a level yellow dyeing on the yarn having good fastness properties.

EXAMPLE 4

10 parts of a polyester-cotton blend fabric are padded with an aqueous liquor containing 50 parts of N-(2-sulfatoethyl)piperazine and 30 parts of sodium hydroxide on 1000 parts of water to a wet pickup of 80%, based on the weight of the fabric, and then subjected to thermofixing at 180° C. for 45 seconds. The material is then rinsed cold and washed hot at 60° C. for 10 minutes with or without a nonionic wetting agent. After another rinse with cold water, the material is transferred into an HT dyeing apparatus and treated at a liquor ratio of 20:1 with an aqueous liquor containing in dispersion 0.15 part of the fiber-reactive disperse dye known from Example 109 of U.S. Pat. No. 3,843,624 The fiber mixture is dyed at 130° C. for 30 minutes. The aftertreatment of the dyeing obtained is effected by rinsing and soaping in a conventional manner. The result obtained is a blue dyeing on both fiber portions having the very good service fastness properties customary in the prior art.

EXAMPLE 5 TO 19

To produce a dyeing according to the invention with a fiber-reactive disperse dye on a modified fiber or fiber blend material, the procedure employed is for example analogous to that of the above Examples 1 to 4, but one of the fiber-reactive dyes indicated in the table examples below is used. The result obtained is a strong dyeing in the hue reported for the respective dye, with good fastness properties and the same shade for the two fiber portions.

| Ex. | fiber-reactive disperse dye | Hue of dyeing |
|---|---|---|
| 5 | 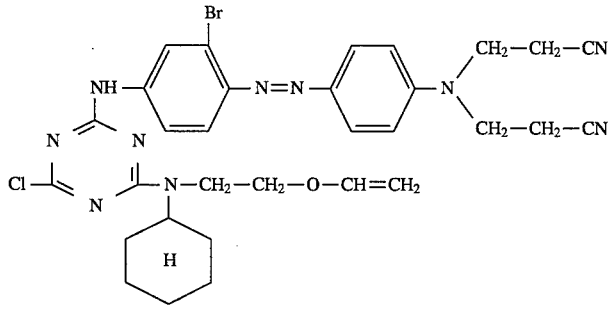 | red |
| 6 | 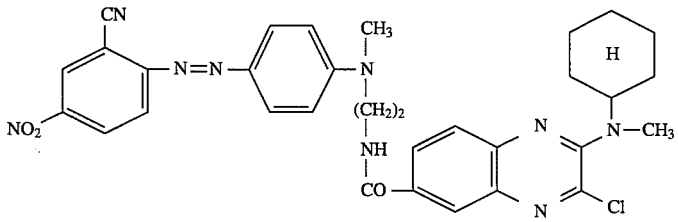 | violet |
| 7 | 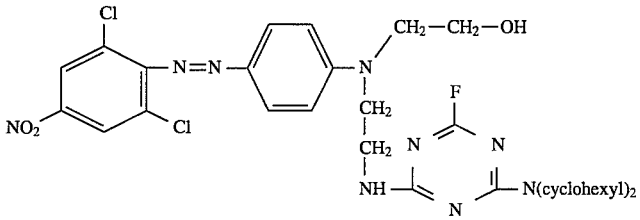 | brown |
| 8 | 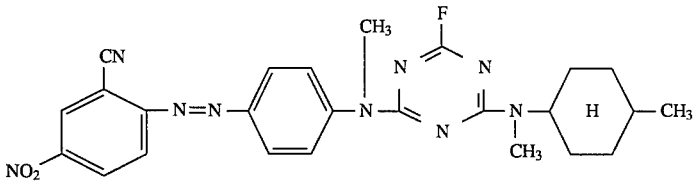 | yellow |

-continued
| Ex. | fiber-reactive disperse dye | Hue of dyeing |
|---|---|---|
| 9 | 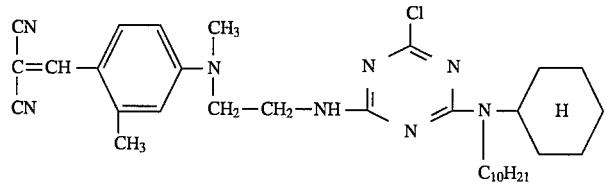 | greenish yellow |
| 10 | 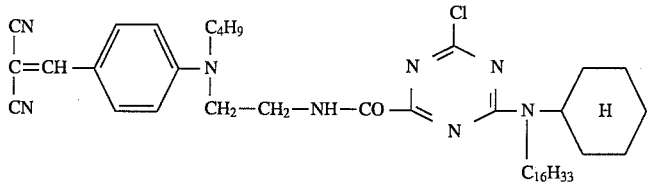 | greenish yellow |
| 11 | 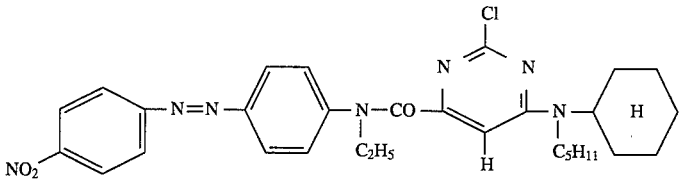 | yellow |
| 12 | 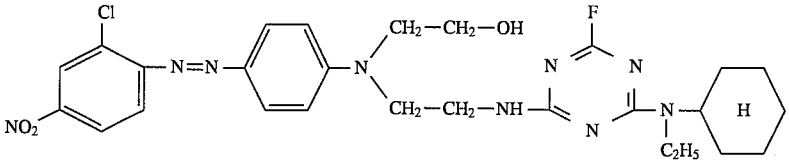 | bordeaux |
| 13 | 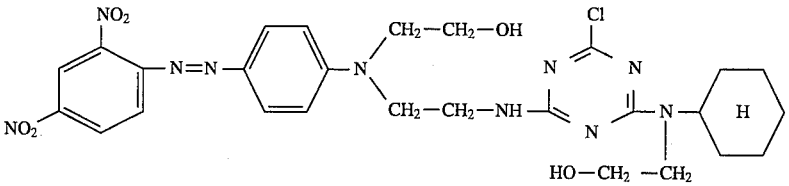 | violet |
| 14 | 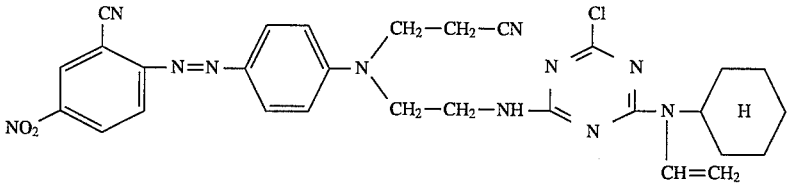 | violet |
| 15 | 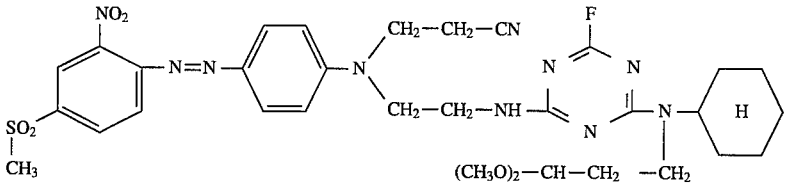 | red |
| 16 | 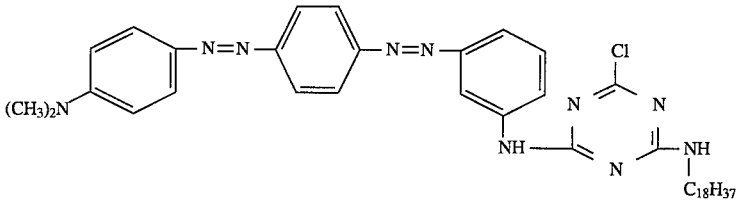 | reddish yellow |

-continued

| Ex. | fiber-reactive disperse dye | Hue of dyeing |
|---|---|---|
| 17 | 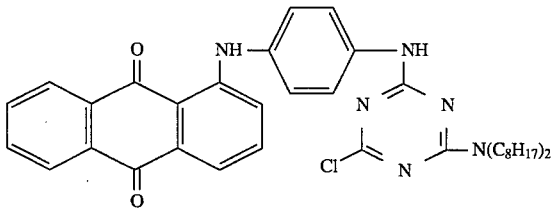 | reddish violet |
| 18 | 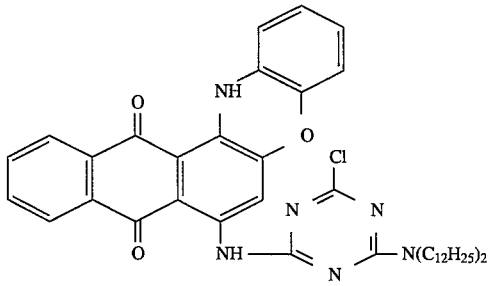 | greenish blue |
| 19 | 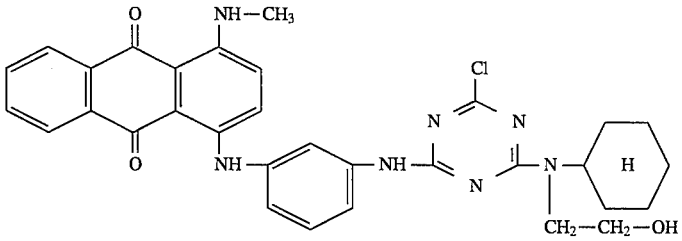 | blue |

What is claimed is:

1. A process for dyeing materials composed of hydroxyl-containing fibers or blends of hydroxyl-containing fibers with polyester fibers, which comprises applying to a hydroxyl-containing fiber material that is a fiber material which has been modified with an amino-containing compound that is selected from the group consisting of (A) a compound of the formula

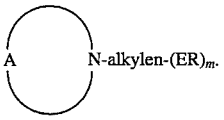

where

ER is an ester group;

A and N together with 1 or 2 alkylene groups of 1 to 4 carbon atoms form the bivalent radical of a heterocyclic ring wherein A is an oxygen atom or a group of the formula (a), (b) or (c)

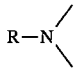 (a)

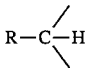 (b)

-continued

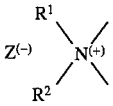 (c)

where

R is a hydrogen atom or an amino group or an alkyl group of 1 to 6 carbon atoms which are optionally substituted by 1 or 2 substituents selected from the group consisting of amino, sulfo, hydroxyl, sulfato, phosphato and carboxyl, or an alkyl group of 3 to 8 carbon atoms which is interrupted by 1 or 2 hetero groups selected from —O— and —NH— and are optionally substituted by an amino, sulfo, hydroxyl, sulfato or carboxyl group, $R^1$ is hydrogen, methyl or ethyl $R^2$ is hydrogen, methyl or ethyl, and $Z^{(-)}$ is an anion;

alkylen is a straight-chain or branched alkylene radical of 2 to 6 carbon atoms which are optionally substituted by 1 or 2 hydroxy groups or is a straight-chain or branched alkylene radical of 3 to 8 carbon atoms which is interrupted by 1 or 2 hetero groups selected from —O— and —NH—;

m is 1 or 2;

the amino, hydroxyl and ester groups can be attached to a primary, secondary or tertiary carbon atom of the alkylene radical, (B) compound of the formula

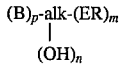

where

ER is an ester group;

B is an amino group of the formula $H_2N$— or an amino or ammonium group of the formula (d) or (e)

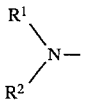

(d)

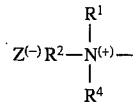

(e)

where $R^1$, $R^2$ and $Z^{(-)}$ are each as defined above, $R^3$ is methyl or ethyl, and $R^4$ is hydrogen, methyl or ethyl;

p is 1 or 2;

alk is a straight-chain or branched alkylene radical of 2 to 6 carbon atoms or is a straight-chain or branched alkylene radical of 3 to 8 carbon atoms which is interrupted by 1 or 2 hetero groups selected from —O— and —NH— m is 1 or 2;

n is from 1 to 4;

the amino, hydroxyl and ester groups can be attached to a primary, secondary or tertiary carbon atom of the alkylene radical and (C) a compound of formula (1)

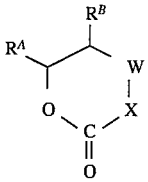

(1)

where $R^A$ is hydrogen or alkyl of 1 to 3 carbon atoms which is optionally substituted by hydroxyl or a group of the formula (2) or (3)

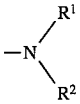

(2)

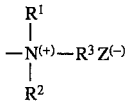

(3)

where $R^1$ is hydrogen, methyl or ethyl, $R^2$ is hydrogen, methyl or ethyl, and $R^3$ is hydrogen, methyl or ethyl, or $R^1$ and $R^2$ together with the nitrogen atom are a saturated heterocyclic radical formed from an alkylene radical of 5 to 8 carbon atoms or two alkylene radicals of 1 to 4 carbon atoms and an oxygen atom or an amino group of the formula —NH—, and $Z^{(-)}$ is an anion, $R^B$ has one of the meanings specified for $R^A$;

W is a direct bond or a group of the formula —$CHR^C$— where $R^C$ has one of the meanings specified for $R^A$;

X is —O— or —NH—, with the proviso that in the case X is —O— at least one group of the formula (2) or (3) must be present, a fiber-reactive disperse dye and dyeing in an aqueous, low electrolyte or completely electrolyte-free medium and in the absence of an alkaline or alkali-donating agent, at a temperature between 100° and 210° C.

2. The process of claim 1, wherein a hydroxyl-containing fiber material modified with an amino-containing compound is dyed with the disperse dye at a temperature between 100° and 140° C.

3. The process of claim 1, wherein a hydroxyl-containing fiber material modified with an amino-containing compound is dyed with the disperse dye at a temperature between 110° and 130° C.

4. The process of claim 1, wherein a fiber blend material composed of a hydroxyl-containing fiber material modified with an amino-containing compound and a polyester fiber is dyed with the disperse dye at a temperature between 120° and 210° C.

5. The process of claim 1, wherein alk is a straight-chain or branched alkylene radical of from 2 to 6 carbon atoms.

6. The process of claim 1, wherein the ester group ER is a sulfato group of the formula —$OSO_3$—M where M is hydrogen or an alkali metal.

7. The process of claim 1, wherein the amino-containing compound is N-(β-sulfatoethyl)piperazine.

8. The process of claim 1, wherein $R^1$ and $R^2$ together with the nitrogen atom are a N-piperazino, N-piperidino or N-morpholino ring.

9. The process of claim 1, wherein $Z^{(-)}$ is chloride, hydrogensulfate or sulfate.

10. The process of claim 1, wherein the amino-containing compound is 2-oxo-1,3-oxazolidine, 4-aminomethyl-2-oxo-1,3-oxazolidine, 5-aminomethyl-2-oxo- 1,3-oxazolidine, 4-(trimethylammoniummethyl)-2-oxo-1,3-oxazolidine chloride or 5 -(trimethylammoniummethyl)-2-oxo-1,3-oxazolidine chloride.

11. The process of claim 1, wherein the amino-containing compound is 1-(trimethylammoniummethyl)ethylene carbonate chloride.

* * * * *